US007080974B2

(12) United States Patent
Lejars et al.

(10) Patent No.: US 7,080,974 B2
(45) Date of Patent: Jul. 25, 2006

(54) RETENTION CAPACITY OF A BLADE HAVING AN ASYMMETRICAL HAMMERHEAD FASTENER, WITH THE HELP OF PLATFORM STIFFENERS

(75) Inventors: Claude Lejars, Draveil (FR); Patrick Reghezza, Vaux le Penil (FR); Jerome Mace, Melun (FR); Christophe Follonier, Saint Fargeau Ponthierry (FR); Bruce Pontoizeau, Paris (FR)

(73) Assignee: SNECMA Moteurs, Paris (FR)

( * ) Notice: Subject to any disclaimer, the term of this patent is extended or adjusted under 35 U.S.C. 154(b) by 17 days.

(21) Appl. No.: 10/866,678

(22) Filed: Jun. 15, 2004

(65) Prior Publication Data

US 2004/0253113 A1 Dec. 16, 2004

(30) Foreign Application Priority Data

Jun. 16, 2003 (FR) ..... 03 07214

(51) Int. Cl.
*F01D 5/30* (2006.01)

(52) U.S. Cl. ..... 416/215; 416/216; 416/220 R

(58) Field of Classification Search ..... 416/215, 416/216, 219 R, 220 R, 204 A
See application file for complete search history.

(56) References Cited

U.S. PATENT DOCUMENTS

| | | | | |
|---|---|---|---|---|
| 2,398,140 | A | 4/1946 | Heppner | |
| 2,494,658 | A | 1/1950 | Highberg et al. | |
| 2,656,147 | A | 10/1953 | Brownhill et al. | |
| 4,304,523 | A | 12/1981 | Corsmeier et al. | |
| 4,349,318 | A | 9/1982 | Libertini et al. | |
| 4,460,315 | A | 7/1984 | Tseng et al. | |
| 5,622,475 | A | 4/1997 | Hayner et al. | |
| 5,919,032 | A * | 7/1999 | Naudet et al. | 416/216 |

FOREIGN PATENT DOCUMENTS

| | | |
|---|---|---|
| EP | 0 530 097 | 3/1993 |
| EP | 0 921 272 | 6/1999 |
| FR | 2 812 906 | 2/2002 |

* cited by examiner

*Primary Examiner*—Edward K. Look
*Assistant Examiner*—Dwayne J White
(74) *Attorney, Agent, or Firm*—Oblon, Spivak, McClelland, Maier & Neustadt, P.C.

(57) ABSTRACT

The invention relates to a bladed disk for a turbomachine, the disk including blades which extend into a conical stream and which are held in a peripheral groove of said disk by hammerhead type fasteners, each of said blades further including a platform whose radially-outer face defines the boundary of the gas flow stream and whose radially-inner face presents an upstream rib and a downstream rib disposed in planes that are perpendicular to the axis of rotation of said disk and that are radially adjacent respectively to an upstream ring and a downstream ring formed at the periphery of said disk on either side of said groove in order to provide leaktightness in these zones, wherein the thickness of the downstream rib in the axial direction is greater than the thickness of the upstream ring.

20 Claims, 2 Drawing Sheets

RETENTION CAPACITY OF A BLADE HAVING AN ASYMMETRICAL HAMMERHEAD FASTENER, WITH THE HELP OF PLATFORM STIFFENERS

The invention relates to a bladed disk of a turbomachine, the disk including blades which extend into a conical stream and which are held in a peripheral groove of said disk by hammerhead type fasteners, each of said blades further including a platform whose radially-outer face defines the boundary of the gas flow stream and whose radially-inner face presents an upstream rib and a downstream rib disposed in planes that are perpendicular to the axis of rotation of said disk and that are radially adjacent respectively to an upstream ring and a downstream ring formed at the periphery of said disk on either side of said groove in order to provide leaktightness in these zones.

BACKGROUND OF THE INVENTION

In turbojets having a large dilution ratio, the radius of the primary flow stream decreases from upstream to downstream in the low pressure compressor. This stream is very highly conical in the last stages of the compressor. The blades of these stages extend obliquely into the stream relative to a plane perpendicular to the axis of rotation of the compressor, i.e. obliquely relative to the radial direction of centrifugal forces.

The invention relates more precisely to bladed disks of this type in which the blades are held by respective fasteners of hammerhead type received in a peripheral groove of the disk, the groove being defined by an upstream lip and a downstream lip having surfaces connected to the bottom of the groove that form bearing surfaces against which the flanks of blade roots come to bear while the turbomachine is in operation, these bearing surfaces withstanding reaction forces with a resultant that is preferably in the plane of the centrifugal forces to which the blades are subjected.

To achieve this result, EP 0 695 856 proposes an asymmetrical hammerhead fastener, i.e. one in which the angle of the bearing surface of the upstream lip, which is the lip of larger diameter, relative to a plane perpendicular to the axis of rotation is greater than the angle formed between the bearing surface of the downstream lip and said plane. FIG. 4B of that document shows the blade-disk connection for the case in which the blade, on being subjected to a high level of axial stress, e.g. following an impact from debris ingested by the turbomachine, tends to pivot about a center of rotation C that is situated at the upstream end of the bearing surface of the downstream lip. Because of the shape of the groove and of the root of the blade, the blade can escape in the event of a major impact.

U.S. Pat. No. 5,271,718 describes blades of the symmetrical hammerhead fastener type which present platforms having ribs on their radially-inner faces that extend circumferentially and axially and that are designed to avoid vibratory resonance, two of the circumferential ribs co-operating with rings formed at the periphery of the disk to provide leaktightness in these zones. The axial thickness of the ribs is substantially equal to the axial thickness of the rings.

That document shows that the axial ribs formed on the radially-inner faces of the platforms are of height that is smaller than that of the ribs co-operating with the rings. In the event of a high level of axial stress, the ribs situated downstream supports a major fraction of the forces that are generated and they might skid axially on the downstream ring, which can lead to the blade becoming detached.

In addition, in the event of tangential stress, the ends of said ribs can skid on the rings, and even if that does not lead to the blades becoming disengaged, it can nevertheless lead to adjacent edges of two neighboring blades overlapping.

These troubles can occur in particular in a bladed disk of the type mentioned in the introduction of the present specification, in which the blades extend into a stream that is highly conical.

OBJECT AND SUMMARY OF THE INVENTION

The object of the invention is to propose a modified blade which enables those drawbacks to be mitigated.

According to the invention, this object is achieved by the fact that the thickness of the downstream rib in the axial direction is greater than the thickness of the downstream ring.

This disposition makes it possible to offer a contact surface that is plane and uniform between the rib and the ring of the disk, which ring optionally presents a groove for receiving a sealing gasket.

According to another characteristic that is advantageous, the thickness of the upstream rib in the axial direction is greater than the thickness of the upstream ring.

Preferably, the height of the ribs is great enough to limit any possibility of platforms overlapping.

BRIEF DESCRIPTION OF THE DRAWINGS

Other characteristics and advantages of the invention will appear on reading the following description given by way of example and made with reference to the accompanying drawings, in which.

MORE DETAILED DESCRIPTION

Figure 1:
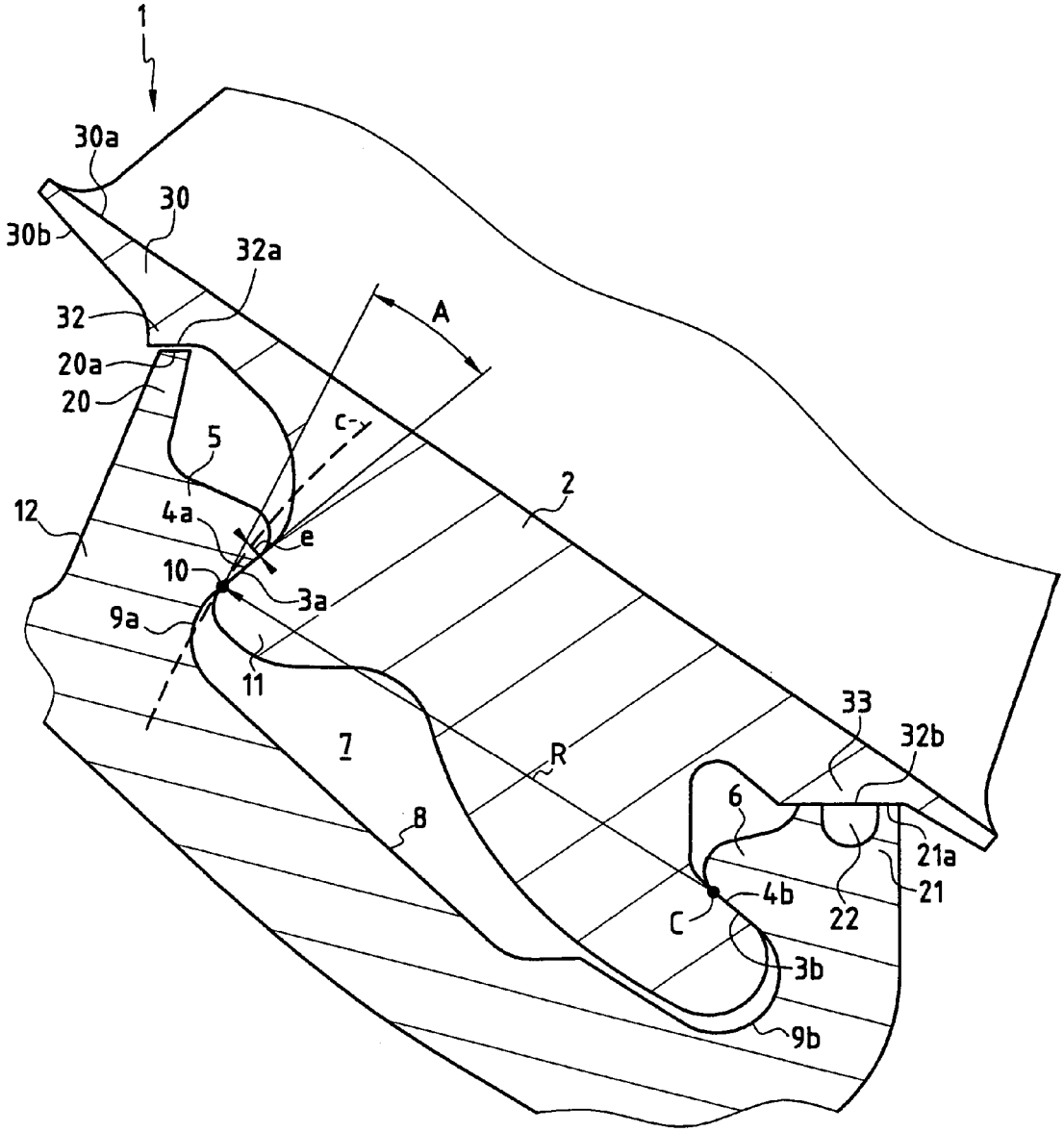
FIG. 1 is a section view on a plane containing the axis of rotation, showing a blade-to-disk connection in accordance with the invention, the blade extending into a highly conical stream, and the fastening being of the asymmetrical hammerhead type.

FIG. 1 shows a blade 1 whose root 2 in the form of a dovetail comprises an upstream flank 3*a* and a downstream flank 3*b* having surfaces that bear against bearing surfaces 4*a* and 4*b* on the inside faces of an upstream lip 5 and a downstream lip 6 which together define a groove 7 formed at the periphery of a disk 12, the bottom 8 of the groove being connected to the bearing surfaces 4*a* and 4*b* via respective rounded surfaces 9*a* and 9*b*.

In the event of large axial stresses due to impact from debris against the aerodynamic portion of the blade 1, the blade tends to pivot about the upstream end C of the bearing surface 4*b* of the downstream lip 6. The end 10 of the heel 11 of the root of the blade 1, i.e. the point that is furthest from the center of rotation C, is urged to describe a circle represented by dashed line C.

It should be observed that the blade 1 extends into a stream that is highly conical, i.e. that the upstream lip 5 is of a diameter that is greater than the downstream lip 6, and the bearing surfaces 4*a* and 4*b* are at different angles relative to the plane perpendicular to the axis of rotation of the disk 2.

At its upstream end, the disk 12 presents a first radial extension 20 referred to as the "upstream ring" in the present specification, which extension is of small axial thickness, and at its downstream end it has a second radial extension 21, referred to herein as the "downstream ring", which includes a groove 22 for receiving a sealing gasket (not shown in the drawings for reasons of clarity).

The upstream and downstream rings 20 and 21 present cylindrical peripheral surfaces 20*a* and 21*a* that are circularly symmetrical about the axis of rotation of the disk 12.

Between its root 2 and its aerodynamic portion, the blade 1 presents a platform 30 whose radially-outer face 30*a* demarcates the conical stream, and whose radially-inner face 30*b* includes an upstream rib 32 and a downstream rib 33 which extend circumferentially in the immediate vicinity of the peripheral surfaces 20*a* and 21*a* of the upstream and downstream rings 20 and 21.

These ribs 32 and 33 present, in particular, cylindrical surface portions respectively 32*a* and 32*b* that are circularly symmetrical about the axis of rotation of the disk 12 and that cover the peripheral surfaces 20*a* and 21*a* of the upstream and downstream rings 21 and 22, and that are of width in the axial direction that is greater than the width of the peripheral surfaces 20*a* and 21*a*.

In the event of axial stress being applied to the blade 1 due to impact from debris, the blade 1 tends to pivot about the point C. This stress leads to positive thrust of the downstream rib 33 against the downstream ring 21.

Because the surface 32*b* is cylindrical and broad in the axial direction, this surface cannot skid over the peripheral surface 21*a* of the ring 21. This disposition prevents the root 2 of the blade from escaping from the groove 7 since it restricts movement of the blade 1.

In the event of a high level of tangential stress, the ends of the two ribs 32 and 33 are thrust positively against the peripheral surfaces 20*a* and 21*a* of the upstream and downstream rings 20 and 21.

The widths of the surfaces 32*a* and 33*a* are calculated so as to ensure that they always provide sufficient bearing areas for the rings 20 and 21 over the entire range of movement of the blade 1 in operation.

Figure 2:
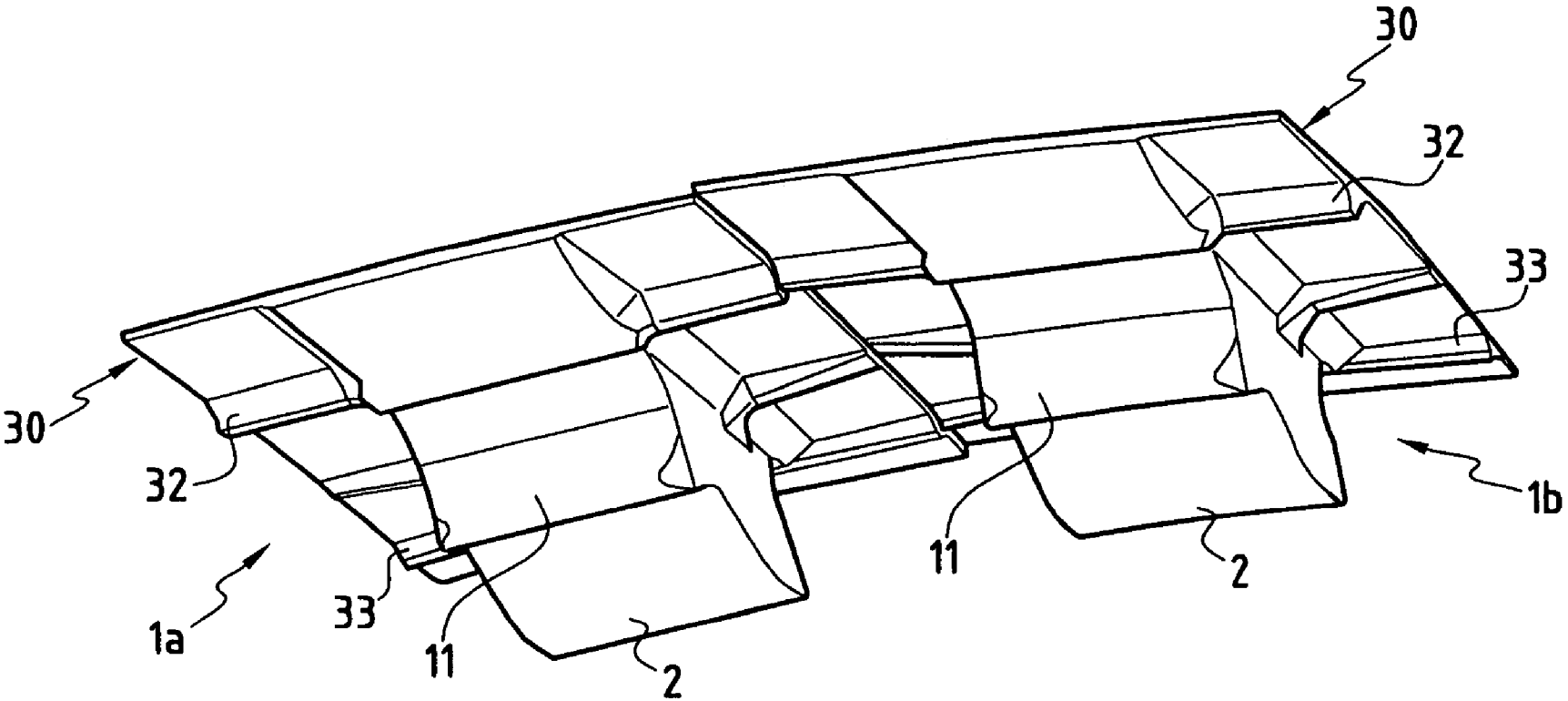
FIG. 2 is a perspective view from below of two adjacent blades 1*a* and 1*b*.

The heights of the ribs 32 and 33 are calculated in such a manner that regardless of the displacement of adjacent blades, due to tangential stress, the adjacent edges of the platforms 30 of two consecutive blades 1*a* and 1*b* cannot overlap, as shown in FIG. 2.

FIG. 2 shows blades 1*a* and 1*b* which also present other stiffening ribs that are disposed between the upstream rib 32 and the downstream rib 33.

The blade could also include ribs directed axially. without going beyond the ambit of the invention.

What is claimed is:

1. A bladed disk for a turbomachine, the disk including blades which extend into a conical stream and which are held in a peripheral groove of said disk by hammerhead type fasteners, each of said blades further including a platform whose radially-outer face defines the boundary of the conical stream and whose radially-inner face presents an upstream rib and a downstream rib disposed in planes that are perpendicular to the axis of rotation of said disk and that are radially adjacent respectively to an upstream ring and a downstream ring formed at the periphery of said disk on either side of said groove in order to provide leaktightness in these zones, wherein the thickness of the downstream rib in the axial direction is greater than the thickness of the downstream ring.

2. A disk according to claim 1, wherein the thickness of the upstream rib in the axial direction is greater than the thickness of the upstream ring.

3. A disk according to claim 1, wherein the height of the ribs is great enough to limit any possibility of platforms overlapping.

4. A disk according to claim 1, wherein each of said blades has a root in the form of a dovetail.

5. A disk according to claim 1, wherein each of said blades has a root comprising an upstream flank and a downstream flank that bear against an upstream lip and a downstream lip of said disk, respectively, said upstream and downstream flanks and lips defining said peripheral groove.

6. A disk according to claim 5, wherein said upstream lip is of diameter that is greater than a diameter of said downstream lip.

7. A disk according to claim 1, wherein said upstream ring has a thickness smaller than that of said downstream ring.

8. A disk according to claim 1, wherein said downstream ring defines a groove configured to receive a sealing gasket.

9. A disk according to claim 1, wherein said upstream and downstream rings present cylindrical peripheral surfaces that are circularly symmetrical about an axis of rotation of said disk.

10. A disk according to claim 1, wherein each of said blades has a single root coupled to said disk.

11. A disk according to claim 1, wherein said upstream and downstream ribs each present a cylindrical surface portion.

12. A disk according to claim 1, wherein said upstream and downstream ribs each present a surface portion that is symmetrical about an axis of rotation of said disk.

13. A disk according to claim 1, wherein said upstream rib presents a surface portion that covers a peripheral surface of said upstream ring.

14. A disk according to claim 13, wherein a width in said axial direction of said surface portion of said upstream rib is greater than a width in said axial direction of said peripheral surface of said upstream ring.

15. A disk according to claim 1, wherein said downstream rib presents a surface portion that covers a peripheral surface of said downstream ring.

16. A disk according to claim 15, wherein a width in said axial direction of said surface portion of said downstream rib is greater than a width in said axial direction of said peripheral surface of said downstream ring.

17. A bladed disk for a turbomachine, the disk defining a peripheral groove configured to receive a root of a blade, said blade including a platform whose radially-outer face defines the boundary of a conical stream and whose radially-inner face presents an upstream rib and a downstream rib disposed in planes that are perpendicular to an axis of rotation of said disk and that are radially adjacent respectively to an upstream ring and a downstream ring formed at a periphery of said disk, wherein said downstream rib presents a surface portion that covers a peripheral surface of said downstream ring, and a width in an axial direction of said surface portion of said downstream rib is greater than a width in said axial direction of said peripheral surface of said downstream ring.

18. A disk according to claim 17, wherein said upstream ring and said downstream ring are formed on either side of said groove.

19. A disk according to claim 17, wherein said upstream rib presents a surface portion that covers a peripheral surface of said upstream ring, and a width in said axial direction of said surface portion of said upstream rib is greater than a width of said peripheral surface of said upstream ring.

20. A disk according to claim 19, wherein said surface portion of said downstream rib and said peripheral surface of said downstream ring form a downstream leaktight contact between said downstream rib and said downstream ring, and said surface portion of said upstream rib and said peripheral surface of said upstream ring form an upstream leaktight contact between said upstream rib and said upstream ring.

* * * * *